US009117434B2

(12) United States Patent
Kim

(10) Patent No.: US 9,117,434 B2
(45) Date of Patent: Aug. 25, 2015

(54) VIBRATION-LEAD PLATE FOR FLAT TYPE SPEAKER, MOUNTED BETWEEN VOICE COIL PLATE AND VIBRATION PLATE

(75) Inventor: Dong-Man Kim, Seoul (KR)

(73) Assignee: EXELWAY INC., Seoul-si (KR)

( * ) Notice: Subject to any disclaimer, the term of this patent is extended or adjusted under 35 U.S.C. 154(b) by 0 days.

(21) Appl. No.: 13/817,184

(22) PCT Filed: Aug. 16, 2011

(86) PCT No.: PCT/KR2011/005987

§ 371 (c)(1),
(2), (4) Date: Mar. 5, 2013

(87) PCT Pub. No.: WO2012/023775

PCT Pub. Date: Feb. 23, 2012

(65) Prior Publication Data

US 2013/0161122 A1 Jun. 27, 2013

(30) Foreign Application Priority Data

Aug. 17, 2010 (KR) ..... 10-2010-0079115

(51) Int. Cl.

| | |
|---|---|
| ***H04R 25/00*** | (2006.01) |
| ***G10K 13/00*** | (2006.01) |
| ***H04R 7/16*** | (2006.01) |

(Continued)

(52) U.S. Cl.

CPC *G10K 13/00* (2013.01); *H04R 1/06* (2013.01); *H04R 7/16* (2013.01); *H04R 9/043* (2013.01); *H04R 31/006* (2013.01); *H04R 7/04* (2013.01); *H04R 9/047* (2013.01)

(58) Field of Classification Search

CPC ..... H04R 9/02; H04R 9/025; H04R 9/04; H04R 9/06; H04R 7/16; H04R 7/18; H04R 2307/207; H04R 1/06; H04R 9/043; H04R 9/045; H04R 9/047; H04R 7/04; H04R 31/003; H04R 31/006; H04R 2231/003

USPC ..... 381/396, 398, 399, 403, 404, 405, 408, 381/431, 162, 191; 181/171, 172

See application file for complete search history.

(56) References Cited

U.S. PATENT DOCUMENTS

| | | | | |
|---|---|---|---|---|
| 5,664,024 | A * | 9/1997 | Furuta et al. | 381/412 |
| 6,594,372 | B2 * | 7/2003 | Nakaso | 381/396 |

(Continued)

FOREIGN PATENT DOCUMENTS

| | | |
|---|---|---|
| JP | 2002-176693 | 6/2002 |
| KR | 10-2009-0040952 | 4/2009 |

(Continued)

*Primary Examiner* — Huyen D Le

(74) *Attorney, Agent, or Firm* — Occhiuti & Rohlicek LLP

(57) ABSTRACT

A vibration-lead plate for a flat speaker is mounted between a voice coil plate and a vibration plate for increasing vibrational efficiency and removing the lead wire of a voice coil. The vibration-lead plate includes: a coil plate-spline, mounted between a voice coil plate having a voice coil formed in the shape of a spiral track and a vibration plate to vibrate according to the movement of the voice coil plate for generating sound, and formed in the center so as to be adhered to the voice coil plate; an edge-spline, connected to one side of the coil plate-spline and the edge of the vibration plate so as to variably correspond to vibrations; and a vibration plate outside portion, connected to one side of the edge-spline and adhered to the outside portion of the edge of the vibration plate.

8 Claims, 8 Drawing Sheets

(51) Int. Cl.

| | |
|---|---|
| ***H04R 9/04*** | (2006.01) |
| ***H04R 1/06*** | (2006.01) |
| ***H04R 31/00*** | (2006.01) |
| *H04R 7/04* | (2006.01) |

(56) References Cited

U.S. PATENT DOCUMENTS

| | | | | |
|---|---|---|---|---|
| 6,714,655 | B2 * | 3/2004 | Iwasa et al. | 381/396 |
| 7,840,025 | B2 * | 11/2010 | Ikeda et al. | 381/404 |
| 2014/0037114 | A1 * | 2/2014 | Kim | 381/162 |
| 2014/0044287 | A1 * | 2/2014 | Kim et al. | 381/191 |

FOREIGN PATENT DOCUMENTS

| | | |
|---|---|---|
| KR | 10-2010-0011199 | 2/2010 |
| KR | 10-0963559 | 6/2010 |

* cited by examiner

VIBRATION-LEAD PLATE FOR FLAT TYPE SPEAKER, MOUNTED BETWEEN VOICE COIL PLATE AND VIBRATION PLATE

CROSS-REFERENCE TO RELATED APPLICATION

This application is the national phase under 35 USC 371 of international application no. PCT/KR2011/005987, filed Aug. 16, 2011, which claims the benefit of the priority date of Korean application no. 10-2010-0079115, filed Aug. 17, 2010. The contents of the aforementioned applications are incorporated herein in their entirety.

TECHNICAL FIELD

The present invention relates to a flat panel type speaker and, more particularly, to a vibration-lead plate for a flat panel type speaker mounted between a voice coil plate and a vibration plate, which is capable of increasing vibration efficiency, simplifying a production process by obviating the lead wire of a voice coil, and improving quality due to a break phenomenon of the lead wire.

BACKGROUND ART

A speaker includes voice coils and a vibration plate interposed between magnets. The speaker generates sound when the vibration plate is vibrated in conjunction with movements of the voice coils.

A flat panel type speaker includes flat panel type voice coils and magnets disposed on both sides of the flat panel type voice coils at a specific interval. The flat panel type speaker forms a frequency by generating organic electromagnetic force in accordance with Flemming's left-hand law and Lorenz's principle, and the frequency vibrates a vibration plate so that the frequency reappears in the form of sound.

The voice coil is wound or print-patterned on a single side or both sides of a plate type coil base in an elliptical form, thus forming the voice coil plate.

The vibration plate is attached to the top of the voice coil plates in a length direction. Sound is generated when the vibration plate is vibrated in conjunction with a movement of the voice coil plate.

Furthermore, the voice coils formed in the voice coil plates are bonded to both terminals of a base frame that has + and − lead wires form an external appearance, thereby forming a circuit.

In the conventional voice coil plates, however, a contact area between the voice coil plates and the vibration plate is small because the voice coils are adhered to the vibration plate in an upright state. As a result, the transfer of vibration energy is limited.

Furthermore, the voice coil plate can be moved up and down because the lead wires formed in the voice coil plates are bonded to the base frame, but there is a problem in that the bonding between the lead wires and the base frame is broken because the base frame is fixed.

Furthermore, the lead wires of the voice coil plates are coupled with the terminals of the base frame by using a soldering method in a process, but this method is problematic in that it degrades the quality of a speaker.

DISCLOSURE

Technical Problem

An object of the present invention for solving the conventional problems is to transfer more sound energy by connecting a vibration-lead plate between a voice coil plate and a vibration plate.

Furthermore, an object of the present invention is to reduce a process by obviating a complicate process of soldering a lead wire for electrical connection from a voice coil to the terminal of a base frame and solve a reduction of quality resulting from the connection of a lead wire.

Technical Solution

In a vibration-lead plate mounted between a voice coil plate for a flat panel type speaker and a vibration plate in accordance with the present invention for solving the problems, the vibration-lead plate is mounted between the voice coil plate having a voice coil of a spiral track form formed therein and the vibration plate vibrated in response to a movement of the voice coil plate, thus generating sound, and the vibration-lead plate may include a coil plate-spline formed in a central part of the vibration-lead plate and adhered to the voice coil plate, an edge-spline connected to one side of the coil plate-spline, connected to an edge of the vibration plate, and variably moved in response to vibration of the vibration plate, and a vibration plate outside-spline connected to one side of the edge-spline and adhered to an outside part of the edge of the vibration plate.

Furthermore, a vibration-lead plate mounted between a voice coil plate for a flat panel type speaker and a vibration plate in accordance with the present invention may have a structure in which the vibration-lead plate is mounted between the voice coil plate having a voice coil of a spiral track form formed therein and the vibration plate vibrated in response to a movement of the voice coil plate, thus generating sound, a plurality of splines is coupled together and formed in the vibration-lead plate, and a central part of the vibration-lead plate is adhered to a top of the voice coil plate, and in a state in which one or more of an outside and inside of the vibration-lead plate are adhered to the vibration plate and one of the outside and inside of the vibration-lead plate is fixed, the other of the outside and inside of the vibration-lead plate fluctuates in a sheet spring or damper form.

Here, it is preferred that terminals connected to power supply terminals formed in a base frame that forms an external appearance be formed at both ends of the vibration plate outside-spline.

Here, it is preferred that a pair of the vibration-lead plates be formed and physically separated from each other and the other vibration-lead plate be symmetrical to the one vibration-lead plate based on the one vibration-lead plate and rotated 180 degrees.

Here, it is preferred that terminals connected to power supply terminals formed in a base frame that forms an external appearance be formed at both ends of the vibration plate outside-spline of each of the pair of vibration-lead plates.

Here, it is preferred that the coil plate-spline, the edge-spline, and the vibration plate outside-spline of each of the pair of vibration-lead plates be leaned toward one side based on a center point in a length direction and formed.

Here, it is preferred that in the state in which the pair of the vibration-lead plates are located and arranged, the pair of the vibration-lead plates be symmetrical to each other left and right and up and down based on a center line of each of horizontal and vertical directions.

Here, it is preferred that the vibration-lead plate further include a vibration plate inside-spline adhered to an inside part of the vibration plate edge.

Advantageous Effects

In accordance with the construction of the present invention, more sound energy can be transferred by connecting the vibration-lead plate between the voice coil plate and the vibration plate, a process can be reduced by obviating a complicate process of soldering a lead wire for electrical connection from the voice coil to the terminal of the base frame, and a problem in which quality is deteriorated due to the connection of a lead wire can be solved.

Figure 1:
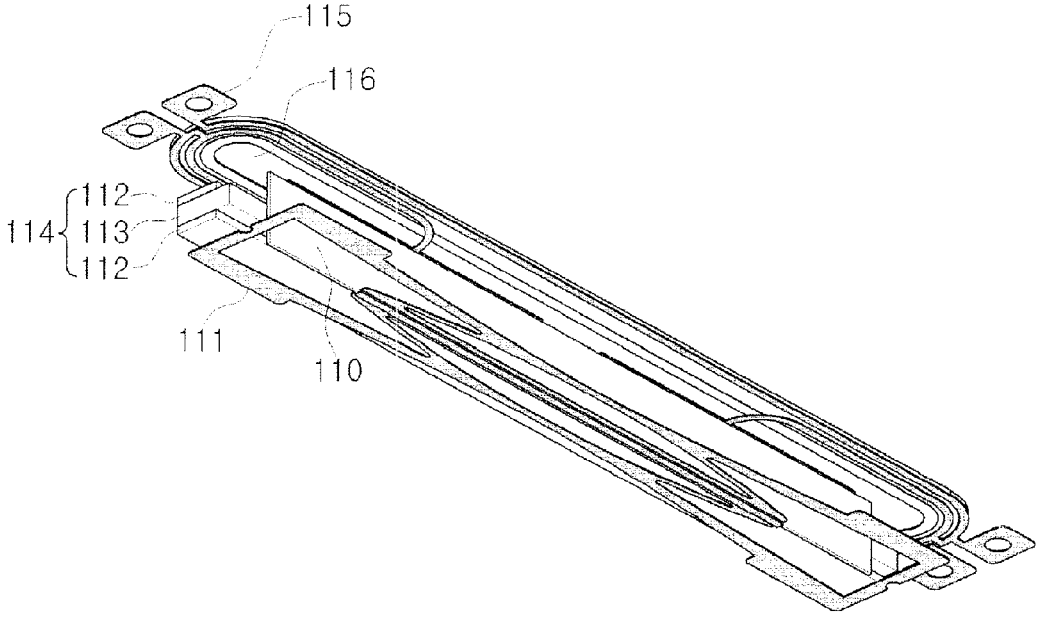
FIG. 1 is a perspective view of a flat panel type speaker with which a vibration-lead plate in accordance with the present invention is coupled.

<Description of reference numerals of principal elements in the drawings>

| | |
|---|---|
| 110: voice coil plate | 111: damper |
| 112: york | 113: magnet |
| 114: magnetic body | 116: vibration plate |
| 201: vibration plate edge | |
| 202: vibration plate outside | |
| 203: vibration plate-inside | |
| 115, 300, 400, 500: vibration-lead plate | |
| 301a, 401a, 501a: first vibration-lead plate | |
| 301b, 401b, 501b: second vibration-lead plate | |
| 302a, 402a, 502a: vibration plate outside-spline | |
| 303a, 403a, 503a: coil plate-spline | |
| 304a, 404a, 504a: edge-spline | |
| 305a, 405a, 505a: terminal | |
| 406a: vibration plate inside-spline | |

MODE FOR INVENTION

The structures and effects of a vibration-lead plate mounted between a voice coil plate for a flat panel type speaker and a vibration plate in accordance with the present invention are described below with reference to the accompanying drawings.

Figure 2:
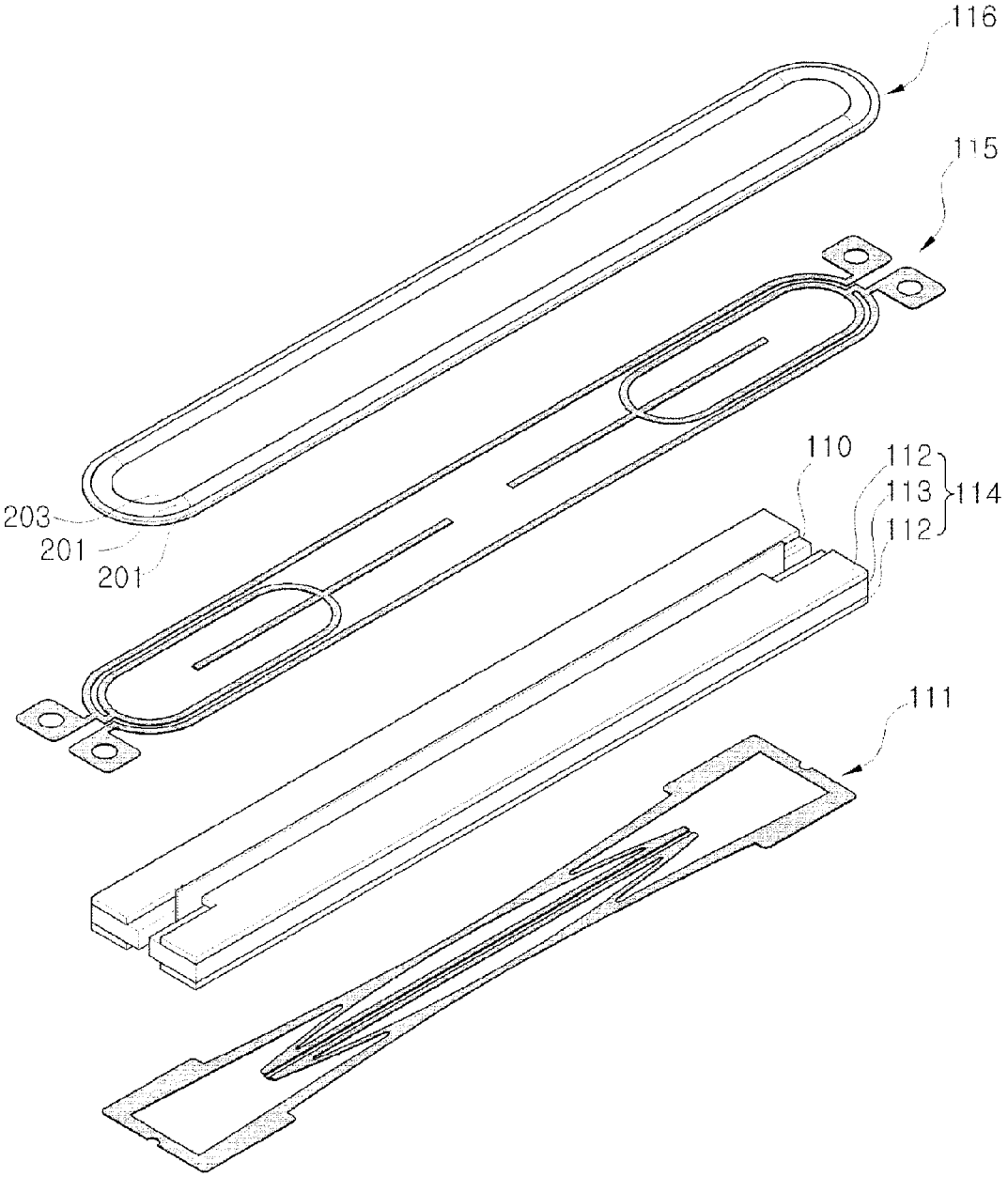
FIG. 2 is an exploded perspective view of a flat panel type speaker with which the vibration-lead plate in accordance with the present invention is coupled.

FIG. 1 is a perspective view of a flat panel type speaker with which a vibration-lead plate in accordance with the present invention is coupled, and FIG. 2 is an exploded perspective view of a flat panel type speaker with which the vibration-lead plate in accordance with the present invention is coupled.

As shown in FIG. 1, the flat panel type speaker in accordance with the present invention includes a voice coil plate 110 configured to have a voice coil wound in a track form or printed in a pattern formed therein, a pair of magnetic bodies 114 (only one magnetic body is shown in FIG. 1) spaced apart from each other at a specific interval on the left and right sides of the voice coil plate 110, a damper 111 connected to the bottom of the voice coil plate 110 and configured to assist up and down movements of the voice coil plate 110, a vibration-lead plate 115 connected to the top of the voice coil plate 110 and coupled with a vibration plate 116, and the vibration plate 116 adhered to the top of the vibration-lead plate 115 in a length direction and configured to transfer vibration energy in a sound form. A base frame (not shown) made of synthetic resins, forming an external appearance, and with which various parts can be combined can be further formed in the flat panel type speaker.

The magnetic body 114 can have a form in which a magnet 113 is formed at the center of the magnetic body 114 and yorks or magnet plates 112 are combined with the top and bottom of the magnet 113.

The flat panel type speaker of the present invention includes the voice coil plate 110 and the magnetic bodies 114 disposed at a specific interval on both sides of the voice coil plate 110. When an electric current flows through a voice coil, organic electromagnetic force is generated in accordance with Flemming's left-hand law and Lorenz's principle, thus moving the voice coil plate 110 up and down. At this time, the damper 111 combined with the bottom of the voice coil plate 110 assists the up and down movements of the voice coil plate 110, and the vibration-lead plate 115 combined with the top of the voice coil plate 110 functions to transfer more vibration to the vibration plate 116.

The structures of vibration-lead plates to be implemented by the present invention are described in detail with reference to FIGS. 3 to 8.

Figure 3:
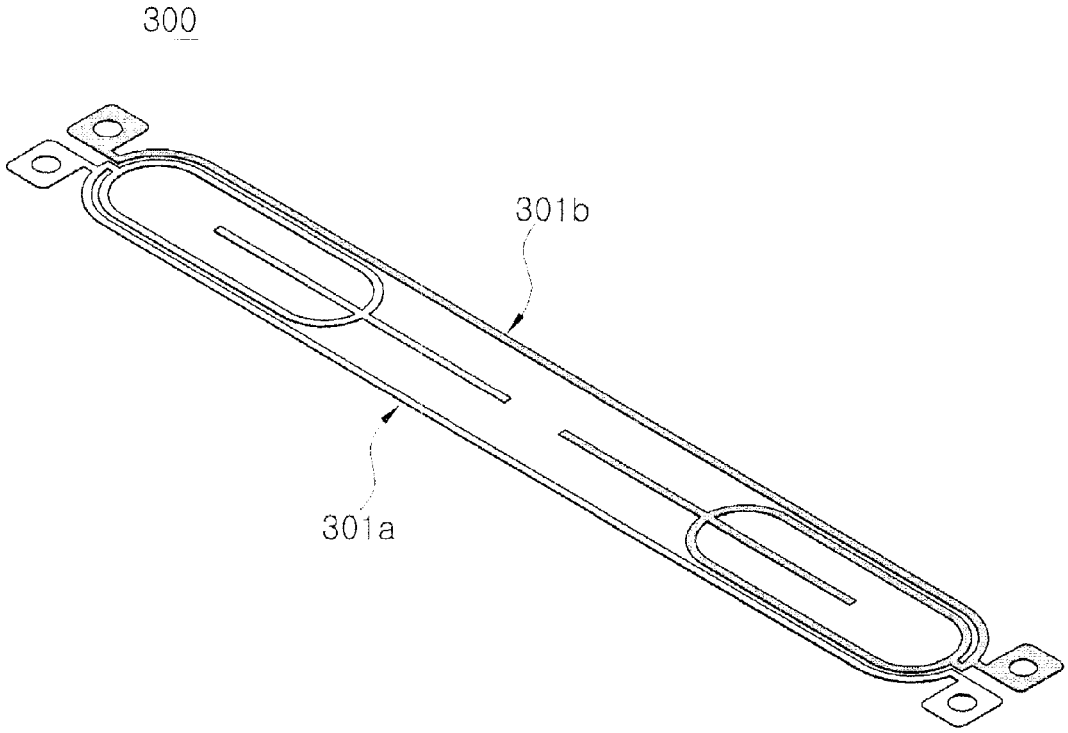
FIG. 3 is a perspective view of a vibration-lead plate for a flat panel type speaker in accordance with one embodiment of the present invention.
Figure 4:
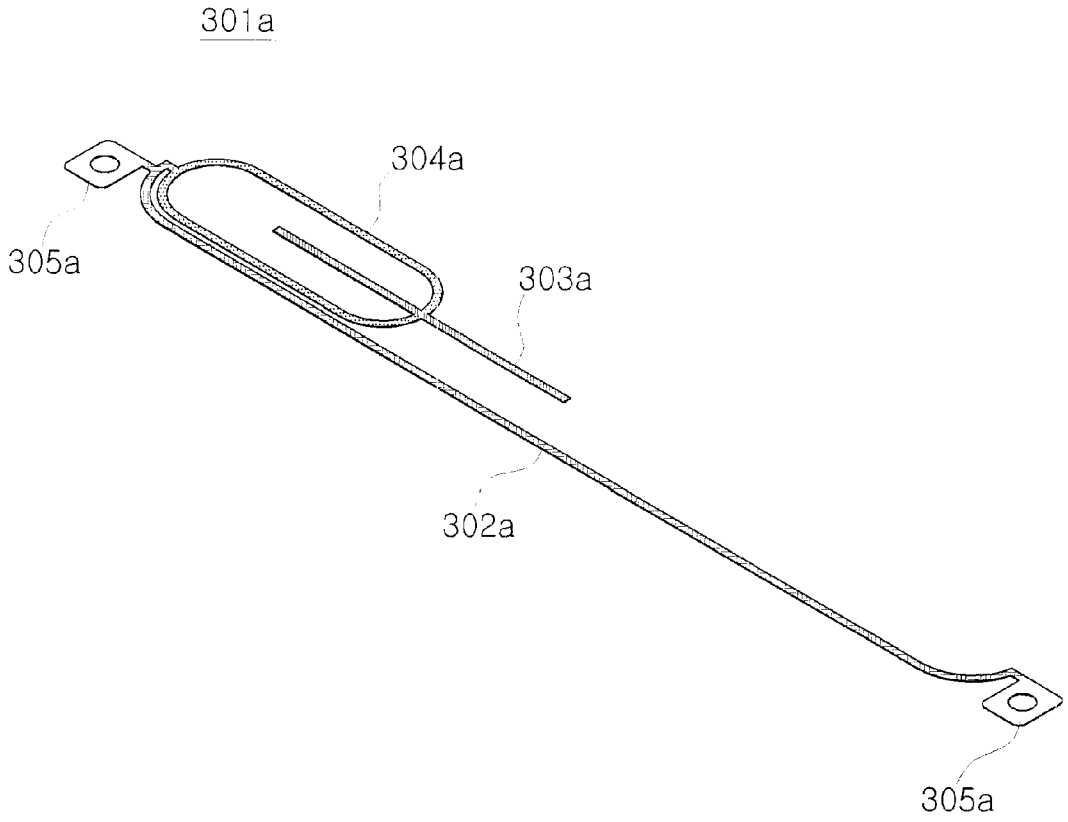
FIG. 4 is a partial perspective view for illustrating the structure of the vibration-lead plate for a flat panel type speaker in accordance with one embodiment of the present invention.
Figure 5:
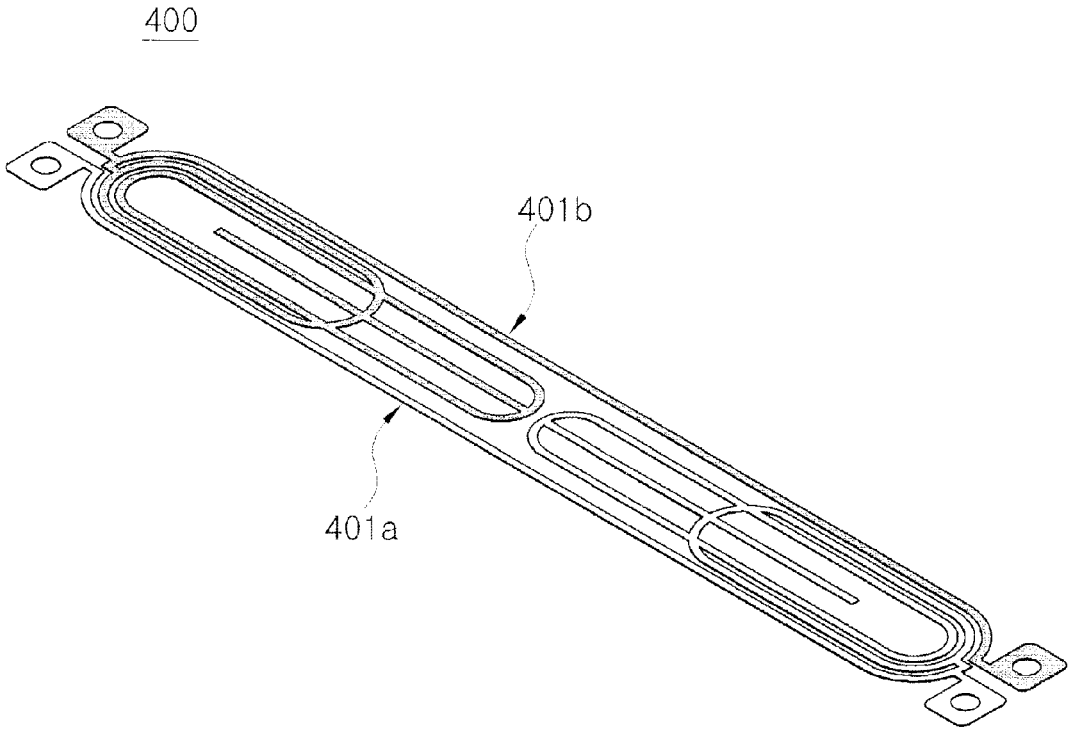
FIG. 5 is a perspective view of a vibration-lead plate for a flat panel type speaker in accordance with another embodiment of the present invention.

The vibration-lead plates shown in FIGS. 3 to 5 are not included in conventional flat panel type speakers and are newly described in the present invention.

The vibration-lead plate becomes auxiliary means for transferring more vibration energy to the vibration plate between the voice coil plate and the vibration plate. Furthermore, terminals are formed at both ends of the vibration-lead plate, and the vibration-lead plate is formed of a metal plate. Accordingly, the soldering connection of a lead wire used for circuit connection with the existing voice coil can be obviated, and a failure due to the break of the lead wire can be obviated and difficulties in process can be solved by replacing the function of the lead wire with the metal plate.

Various types of splines that form the vibration-lead plate are dictionary meanings, and the spline refers to a slim, long, and thin plate made of metal, etc.

Each of vibration-lead plates 300, 400, and 500 described as preferred embodiments hereinafter is mounted between the voice coil plate having a voice coil of a spiral track form formed therein and the vibration plate vibrated in conjunction with a movement of the voice coil plate, thus generating sound. The vibration-lead plate is formed of a plurality of splines coupled together, and the vibration-lead plate has a central part adhered to the top of the voice coil plate. In the state in which one or more of the outside and the inside of the vibration-lead plate are adhered to the vibration plate, one of the outside and the inside of the vibration-lead plate is fixed and the other of the outside and the inside thereof fluctuates in the form of a sheet spring or a damper.

[Vibration-Lead Plate in Accordance with One Embodiment of the Present Invention]

FIG. 3 is a perspective view of a vibration-lead plate for a flat panel type speaker in accordance with one embodiment of the present invention, and FIG. 4 is a partial perspective view for illustrating the structure of the vibration-lead plate for a flat panel type speaker in accordance with one embodiment of the present invention.

Referring to FIG. 3, the vibration-lead plate 300 in accordance with one embodiment of the present invention includes a pair of a first vibration-lead plate 301*a* and a second vibration-lead plate 301*b* on the left and right.

The first and the second vibration-lead plates 301*a* and 301*b* are physically separated from each other and made of a thin metal film having conductivity. One of the first and the second vibration-lead plates 301*a* and 301*b* is a + terminal and the other thereof is a – terminal, thus forming a circuit.

The second vibration-lead plate 301*b* has been rotated 180° around the center point of a location where the second vibration-lead plate 301*b* is symmetrical with the first vibration-lead plate 301*a* on the basis of an oblique line that is parallel to the length direction of the first vibration-lead plate 301*a*. The first and the second vibration-lead plates 301*a* and 301*b* are symmetrical to each other left and right and up and down on the basis of the center point.

The reason why the first and the second vibration-lead plates 301*a* and 301*b* are symmetrical to each other left and right and up and down so that the first and the second vibration-lead plates 301*a* and 301*b* have the same structure is for taking advantages in a production process and transferring the same vibration energy to the vibration plate 116. However, there is no problem even if the first and the second vibration-lead plates 301*a* and 301*b* have different structures.

Referring to FIG. 4, the vibration-lead plate shown in FIG. 4 corresponds to the first vibration-lead plate 301*a* shown in FIG. 3 in order to describe the structure thereof, and the second vibration-lead plate 301*b* has the same structure as the first vibration-lead plate 301*a*.

The first vibration-lead plate 301*a* includes a vibration plate outside-spline 302*a*, a coil plate-spline 303*a*, an edge-spline 304*a*, and terminals 305*a*, which are integrally coupled seamlessly.

Prior to a description, referring back to FIG. 2, the vibration plate 116 is classified into a vibration plate edge 201 convexly formed at which vibration is actually performed, a vibration plate outside 202 formed in the outside of the vibration plate edge 201 and adhered to a base frame (not shown), and a vibration plate-inside 203 in which a vibration plate vibrated along with the vibration plate edge 201 is formed.

The vibration plate outside-spline 302*a* is a part adhered to the part of the vibration plate outside 202, the coil plate-spline 303*a* is a part adhered to the voice coil plate 110, and the edge-spline 304*a* is a part adhered to the vibration plate edge 201.

The terminals 305*a* are formed at both ends of the first vibration-lead plate 301*a* and are parts fastened with the terminals of the base frame (not shown), the + and – wire parts of the voice coil are soldered to the edge-spline 304*a*, + of the voice coil is coupled with the first vibration-lead plate 301*a*, and – of the voice coil is coupled with the second vibration-lead plate 301*b*. The terminals 305*a* of the first and the second vibration-lead plates 301*a* and 301*b* are coupled with the terminals of the base frame, thus forming an electrical circuit.

The existing connection between the voice coil and the terminals of the base frame is implemented using a lead wire through a soldering process. In this case, a work process is problematic, and a phenomenon in which the lead wire can be broken can occur because the terminals of the base frame are fixed, but the voice coil plate fluctuates up and down. The vibration-lead plate 300 of the present invention can supplement the problems.

That is, in the case of the present invention, since the wire of the voice coil and the edge-spline 304*a* are coupled together, the voice coil plate and the edge-spline 304*a* can fluctuate at the same time, thereby being capable of obviating a phenomenon in which the voice coil is broken from the vibration-lead plate 300. Furthermore, there is an advantage in that efficiency of a production process can be improved because the existing lead wire process is obviated by a connection task between the voice coil and the edge-spline 304*a*.

The vibration plate outside-spline 302*a* is adhered to the base frame and fixed thereto, and the coil plate-spline 303*a* is adhered to the voice coil plate 110 and moved in conjunction with up and down movements of the voice coil plate 110. The edge-spline 304*a* is coupled with one side of the coil plate-spline 303*a* and the vibration plate edge 201 and is moved in conjunction with a movement of the voice coil plate 110 and the vibration of the vibration plate 116, thus vibrating up and down like a sheet spring.

As described above, the structure of the vibration-lead plate 300 can transfer more sound energy to the vibration plate 116 and improve quality of a speaker because the voice coil plate 110 and the vibration plate 116 are coupled together in the form of a sheet spring. Furthermore, efficiency of a production process can be improved and quality can be maintained because a process of connecting the voice coil with the lead wire of the base frame is obviated by forming the vibration-lead plate 300 using a thin metal film and forming the terminals 305*a* at both ends.

[Vibration-Lead Plate in Accordance with Another Embodiment of the Present Invention]

Figure 6:
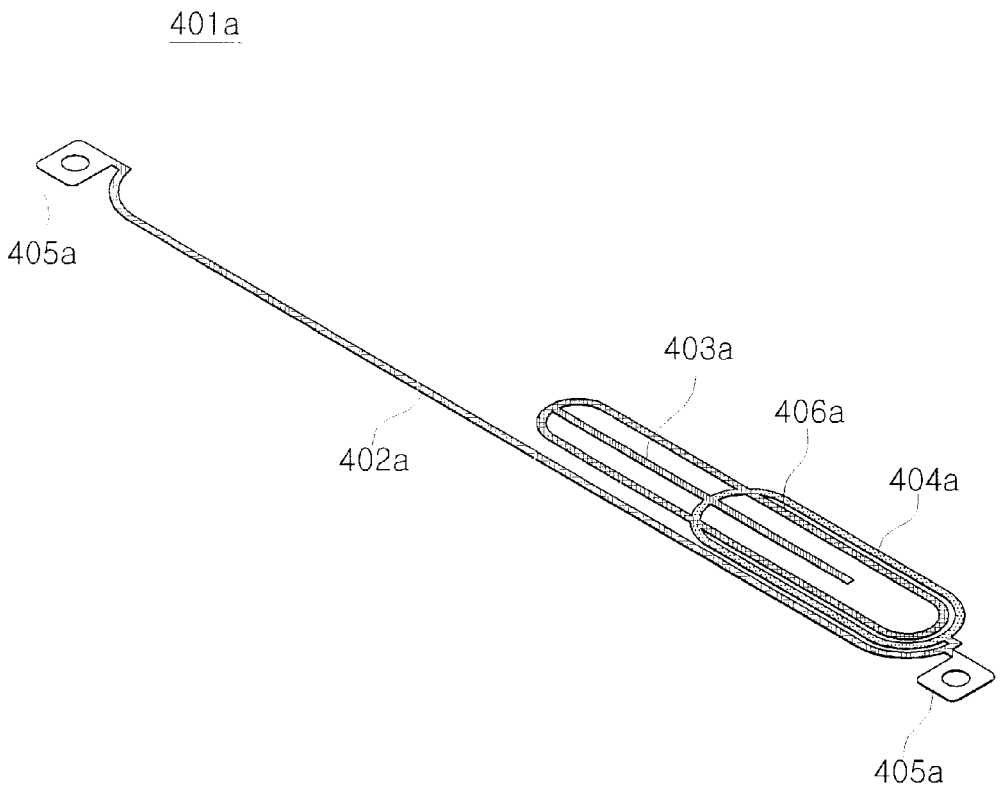
FIG. 6 is a partial perspective view for illustrating the structure of the vibration-lead plate for a flat panel type speaker in accordance with another embodiment of the present invention.

FIG. 5 is a perspective view of a vibration-lead plate for a flat panel type speaker in accordance with another embodiment of the present invention, and FIG. 6 is a partial perspective view for illustrating the structure of the vibration-lead plate for a flat panel type speaker in accordance with another embodiment of the present invention.

First and second vibration-lead plates 401*a* and 401*b* are physically separated from each other and made of a thin metal film having conductivity. One of the first and the second vibration-lead plates 401*a* and 401*b* is a + terminal and the other thereof is a – terminal, thus forming a circuit.

The second vibration-lead plate 401*b* has been rotated 180° around the center point of a location where the second vibration-lead plate 401*b* is symmetrical with the first vibration-lead plate 401*a* on the basis of an oblique line that is parallel to the length direction of the first vibration-lead plate 401*a*. The first and the second vibration-lead plates 401*a* and 401*b* are symmetrical to each other left and right and up and down on the basis of the center point.

The first vibration-lead plate 401*a* includes a vibration plate outside-spline 402*a*, a coil plate-spline 403*a*, an edge-spline 404*a*, a vibration plate inside-spline 406*a*, and terminals 405*a*, which are integrally coupled seamlessly.

Unlike in the embodiment shown in FIGS. 3 and 4, the vibration plate inside-spline 406*a* is further formed.

The vibration plate outside-spline 402*a* is a part adhered to the part of the vibration plate outside 202, the coil plate-spline 403*a* is a part adhered to the voice coil plate 110, the edge-spline 404*a* is a part adhered to the vibration plate edge 201, and the vibration plate inside-spline 406*a* is a part adhered to the vibration plate-inside 203.

The terminals 405*a* are formed at both ends of the first vibration-lead plate 401*a* and are parts fastened with the terminals of the base frame (not shown), the + and – wire parts of the voice coil are soldered to the edge-spline 404*a*, + of the voice coil is coupled with the first vibration-lead plate 401*a*, and – of the voice coil is coupled with the second vibration-lead plate 401*b*. The terminals 405*a* of the first and the second vibration-lead plates 401*a* and 401*b* are coupled with the terminals of the base frame, thus forming an electrical circuit.

The vibration plate outside-spline 402*a* is adhered to the base frame and fixed thereto, the coil plate-spline 403*a* is adhered to the voice coil plate 110 and moved in conjunction with up and down movements of the voice coil plate 110, and the edge-spline 404*a* is coupled with one side of the coil plate-spline 403*a* and the vibration plate edge 201 and is vibrated up and down like a sheet spring in conjunction with a movement of the voice coil plate 110 and the vibration of the vibration plate 116. Furthermore, the vibration plate inside-spline 406*a* is adhered to the vibration plate of the vibration plate-inside 203 and is vibrated in conjunction with the edge-spline 404*a*.

[Vibration-Lead Plate in Accordance with Yet Another Embodiment of the Present Invention]

Figure 7:
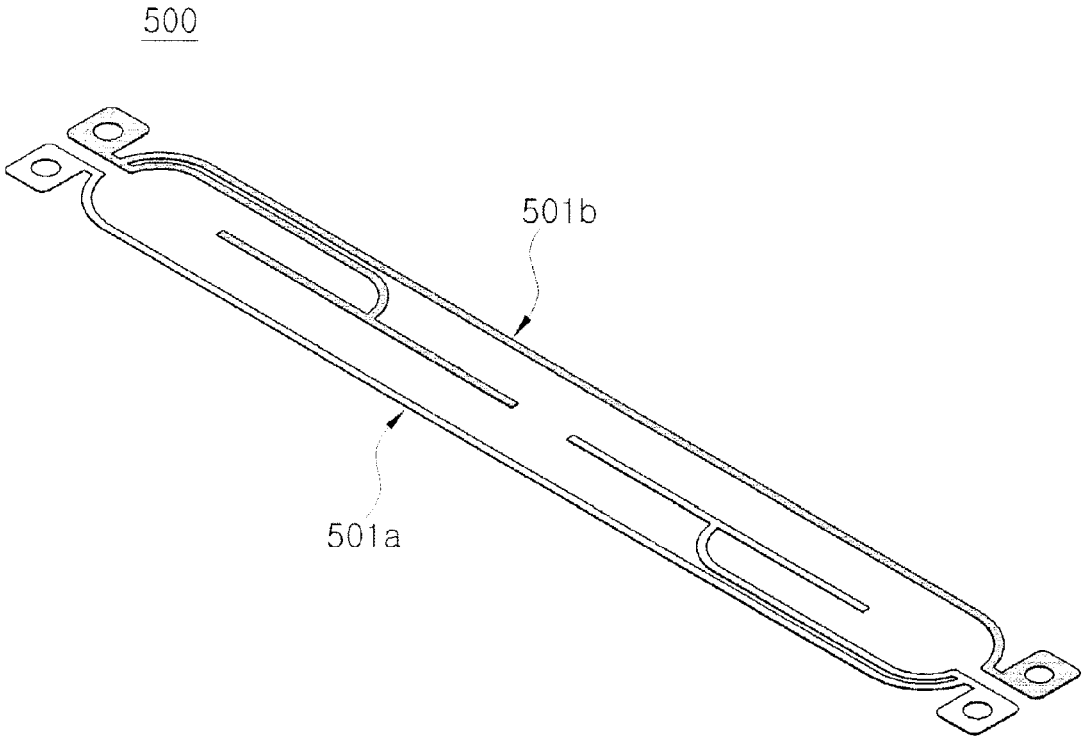
FIG. 7 is a perspective view of a vibration-lead plate for a flat panel type speaker in accordance with yet another embodiment of the present invention.
Figure 8:
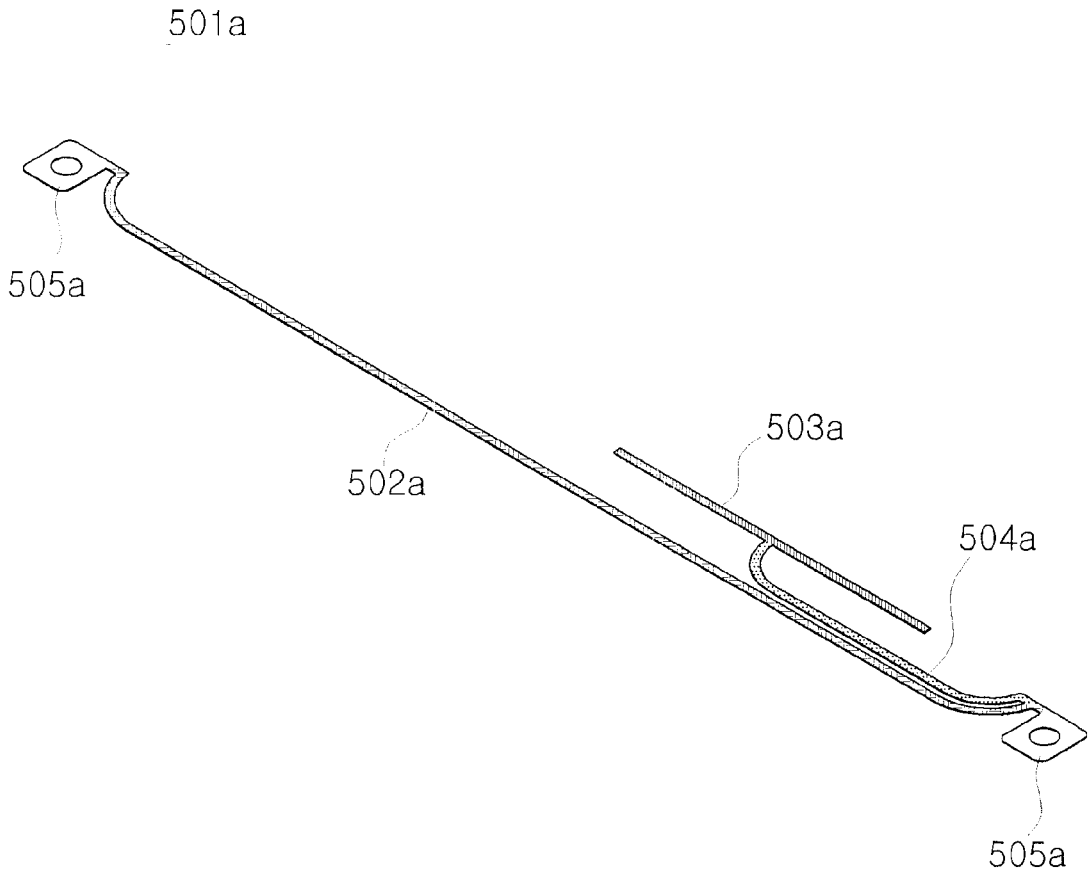
FIG. 8 is a partial perspective view for illustrating the structure of the vibration-lead plate for a flat panel type speaker in accordance with yet another embodiment of the present invention.

FIG. 7 is a perspective view of a vibration-lead plate for a flat panel type speaker in accordance with yet another embodiment of the present invention, and FIG. 8 is a partial perspective view for illustrating the structure of the vibration-lead plate for a flat panel type speaker in accordance with yet another embodiment of the present invention.

First and second vibration-lead plates 501*a* and 501*b* are physically separated from each other and made of a thin metal film having conductivity. One of the first and the second vibration-lead plates 501*a* and 501*b* is a + terminal and the other thereof is a – terminal, thus forming a circuit.

The second vibration-lead plate 501*b* has been rotated 180° around the center point of a location where the second vibration-lead plate 501*b* is symmetrical with the first vibration-lead plate 501*a* on the basis of an oblique line that is parallel to the length direction of the first vibration-lead plate 501*a*. The first and the second vibration-lead plates 501*a* and 501*b* are symmetrical to each other left and right and up and down on the basis of the center point.

The first vibration-lead plate 501*a* includes a vibration plate outside-spline 502*a*, a coil plate-spline 503*a*, an edge-spline 504*a*, and terminals 505*a*, which are integrally coupled seamlessly.

The vibration-lead plate of the present embodiment differs from the embodiment shown in FIGS. 3 and 4 (the edge-spline 304*a* has an elliptical form) in that it has the edge-spline 504*a* structure having a semi-elliptical form to which only a ½ part of the vibration plate edge 201 can be adhered.

The vibration plate outside-spline 502*a* is a part adhered to the part of the vibration plate outside 202, the coil plate-spline 503*a* is a part adhered to the voice coil plate 110, and the edge-spline 504*a* is a part adhered to the vibration plate edge 201.

The terminals 505*a* are formed at both ends of the first vibration-lead plate 501*a* and are parts fastened with the terminals of the base frame (not shown), the + and – wire parts of the voice coil are soldered to the edge-spline 504*a*, + of the voice coil is coupled with the first vibration-lead plate 501*a*, and – of the voice coil is coupled with the second vibration-lead plate 501*b*. The terminals 505*a* of the first and the second vibration-lead plates 501*a* and 501*b* are coupled with the terminals of the base frame, thus forming an electrical circuit.

The vibration plate outside-spline 502*a* is adhered to the base frame and fixed thereto, the coil plate-spline 503*a* is adhered to the voice coil plate 110 and moved in conjunction with up and down movements of the voice coil plate 110, and the edge-spline 504*a* is coupled with one side of the coil plate-spline 503*a* and the vibration plate edge 201 and is vibrated up and down like a sheet spring in conjunction with a movement of the voice coil plate 110 and the vibration of the vibration plate 116.

Although the three embodiments have been described as the preferred embodiments, the three preferred embodiments are illustrated as being only limitative and can be derived in various forms having other structures. Each of the vibration-lead plates having other various forms basically has a structure in which the vibration plate outside-spline, the coil plate-spline, and the edge-spline are integrally coupled and the terminals electrically connected to the terminals of the base frame can be formed at both ends of the vibration-lead plate.

While the preferred embodiments of the present invention have been described with reference to the accompanying drawings, it will be understood that those skilled in the art to which the present invention pertains can implement the technical constructions of the present invention in other various forms without departing from the technical spirit or essential characteristics of the present invention. Accordingly, the aforementioned embodiments should be construed as being illustrative not as being limitative from all aspects. Furthermore, the scope of the present invention is defined by the appended claims rather than the detailed description. It should be understood that all modifications or variations derived from the meanings and range of the present invention and equivalents thereof are included in scope of the appended claims.

The invention claimed is:

1. A vibration-lead plate mounted between a voice coil plate for a flat panel type speaker and a vibration plate, wherein:

the vibration-lead plate is mounted between the voice coil plate having a voice coil of a spiral track form formed therein and the vibration plate vibrated in response to a movement of the voice coil plate, thus generating sound, a plurality of splines is coupled together and formed in the vibration-lead plate, and a central part of the vibration-lead plate is adhered to a top of the voice coil plate, and in a state in which one or more of an outside and inside of the vibration-lead plate are adhered to the vibration plate and one of the outside and inside of the vibration-lead plate is fixed, the other of the outside and inside of the vibration-lead plate fluctuates in a sheet spring or damper form.

2. A vibration-lead plate mounted between a voice coil plate for a flat panel type speaker and a vibration plate, wherein the vibration-lead plate is mounted between the voice coil plate having a voice coil of a spiral track form formed therein and the vibration plate vibrated in response to a movement of the voice coil plate, thus generating sound, and the vibration-lead plate comprises:

a coil plate-spline formed in a central part of the vibration-lead plate and adhered to the voice coil plate, an edge-spline connected to one side of the coil plate-spline, connected to an edge of the vibration plate, and variably moved in response to vibration of the vibration plate, and a vibration plate outside-spline connected to one side of the edge-spline and adhered to an outside part of the edge of the vibration plate.

3. The vibration-lead plate according to claim 2, wherein terminals connected to power supply terminals formed in a base frame that forms an external appearance are formed at both ends of the vibration plate outside-spline.

4. The vibration-lead plate according to claim 2, wherein:

a pair of the vibration-lead plates are formed and physically separated from each other, and the other vibration-lead plate is symmetrical to the one vibration-lead plate based on the one vibration-lead plate and rotated 180 degrees.

5. The vibration-lead plate according to claim 4, wherein terminals connected to power supply terminals formed in a base frame that forms an external appearance are formed at both ends of the vibration plate outside-spline of each of the pair of vibration-lead plates.

6. The vibration-lead plate according to claim 4, wherein the coil plate-spline, the edge-spline, and the vibration plate outside-spline of each of the pair of vibration-lead plates are leaned toward one side based on a center point in a length direction and formed.

7. The vibration-lead plate according to claim 4, wherein in a state in which the pair of the vibration-lead plates are located and arranged, the pair of the vibration-lead plates are symmetrical to each other left and right and up and down based on a center line of each of horizontal and vertical directions.

8. The vibration-lead plate according to claim 2, wherein the vibration-lead plate further comprises a vibration plate inside-spline adhered to an inside part of the vibration plate edge.

* * * * *